United States Patent [19]

Rautio

[11] 4,102,369

[45] Jul. 25, 1978

[54] MACHINE FOR HEWING SMALL SQUARE TIMBER

[76] Inventor: Kauko Rautio, Mänly haya, Mantyharju, Finland

[21] Appl. No.: 762,946

[22] Filed: Jan. 27, 1977

[30] Foreign Application Priority Data

Feb. 23, 1976 [FI] Finland ..... 760460

[51] Int. Cl.[2] ..... B27C 1/08

[52] U.S. Cl. ..... 144/114 R; 144/3 P; 144/208 R; 144/218

[58] Field of Search ..... 144/2 R, 3 P, 41, 218, 144/114 R, 162 R, 208 R

[56] References Cited

FOREIGN PATENT DOCUMENTS 210,837 2/1967 Sweden ..... 144/3 P

*Primary Examiner*—Othell M. Simpson

*Assistant Examiner*—W. D. Bray

*Attorney, Agent, or Firm*—Haseltine, Lake & Waters

[57] ABSTRACT

Machine for hewing small square timber with rectangular cross section from round stocks and comprising two mutually parallel cutter shafts on which cutting blades hewing the timber have been affixed, which blades form a 45° angle with the cutter shaft and have been arranged to rotate synchronously and between which the small square timber piece is fed forward. Every second blade on one and the same cutter shaft is direct 45° upwardly with reference to the cutter shaft and every second blade is directed 45° downwardly with reference to the cutter shaft. The blades have been arranged to rotate synchronously in such manner that an upwardly pointing blade of one cutter shaft will be opposed to a downwardly pointing blade of the other cutter shaft adjacent to the square timber.

1 Claim, 3 Drawing Figures

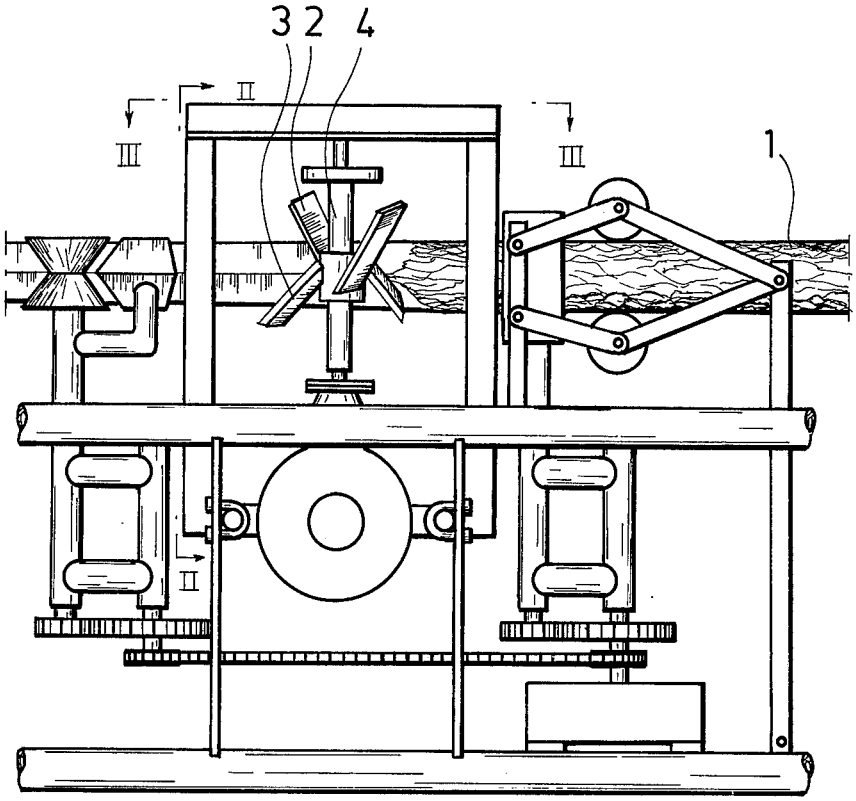
Fig.1
Fig. 2
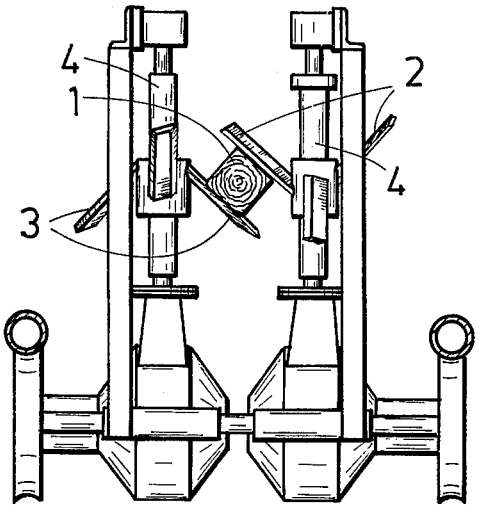
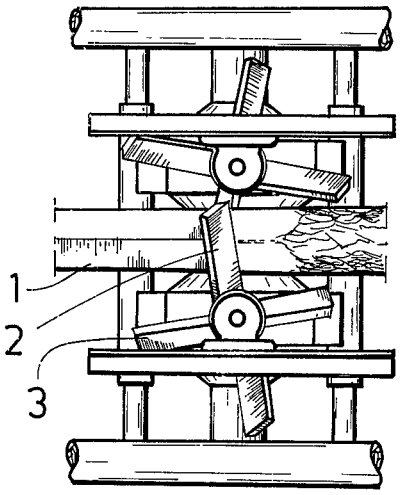
Fig. 3

MACHINE FOR HEWING SMALL SQUARE TIMBER

BACKGROUND OF THE INVENTION

Small square timber hewing machines are known in themselves in prior art. Such a small square timber hewing machine in its overall operation is disclosed in the Finnish. Pat. No. 37,065, published July 31, 1968, said patent is incorporated in the present application by specific reference thereto. The blades performing the hewing operation according to this Finnish Patent have the shape of a right angle with the apex of this angle pointing towards the cutter shaft, and wherein the blades have been arranged to rotate synchronously so that they intermesh adjacent to the square timber. Blades of this kind have the drawback that the blades perform the hewing motion in alternation and the square timber is set into vibration as the result of the hewing motion, and the cut is therefore unsatisfactory. Another drawback has been the lack of sharpness and the broken shape of the corner cut by the blade. Since the blade has the shape of a right angle, it follows that during the hewing motion at the apex of the angle the blade does not cut the square timber; instead, it tears off chips since chips that have already been detached remain in the corner, and as a consequence the result is not tidy.

SUMMARY OF THE INVENTION

The present invention which is an improvement over the Finnish Pat. No. 37,065 eliminates the drawbacks mentioned. The structure of the machine according to the invention is to be understood with reference to Finnish Pat. No. 37,065. Basically it is for hewing small square timber and is characterized in that the blades have been mounted on the cutter shaft in such manner that every second blade on one and the same cutter shaft is directed 45° upwardly with reference to the cutter shaft and every second blade is directed 45° downwardly with reference to the cutter shaft and that the blades have been arranged to rotate synchronously in such manner that an upwardly pointing blade of one cutter shaft will be opposed to a downwardly pointing blade of the other cutter shaft adjacent to the square timber.

Since the blade of one cutter shaft will be opposed to a blade of the other cutter shaft adjacent to the square timber, both blades remove chips from the square timber simultaneously, not in alternation as in prior art. It follows that the square timber will move, guided by the guide and feed rolls, in desired manner forwardly and is not set into vibration.

The invention is described in the following with reference being made to the attached drawing, wherein

IN THE DRAWINGS

FIG. 1 presents an elevational view of the machine.

FIG. 2 shows the cross section of the machine, along the line II-II in FIG. 1.

FIG. 3 shows the machine in top view, viewed in the direction of the arrows III-III.

PREFERRED EMBODIMENT OF THE INVENTION

In accordance with the drawings, the invention employs blade units, both displaceable with reference to each other as required by the size of the square timber 1. In the blade units, the blades have been affixed to the cutter shaft 4 in such manner that every second blade 2 is directed 45° upwardly with reference to the cutter shaft 4 and every second blade 3 is directed 45° downwardly with reference to the cutter shaft 4. The cutter shafts 4 have been arranged to rotate synchronously so that one upwardly pointing blade 2 of the cutter shaft 4 will be opposed to a downwardly pointing blade 3 of the other cutter shaft 4 adjacent to the square time 1. It follows that the cutting forces acting on the square timber 1 are opposed and equal and the axial movement of the square timber 1 remains unchanged. The corner which is produced on the square timber 1 adjacent to the cutter shaft 4 will also be sharp and faultless because the blades 23 of one and the same blade unit cut the square timber 1 in alternation and the chips are detached from the blade after each cut.

It is obvious to one skilled in the art that various embodiments of the invention may vary within the scope of the claim following below.

I claim:

1. An apparatus for hewing substantially small timbers of square cross sectional shape from round tree trunks comprising: supporting means; two vertical and parallel cutting shafts held rotatably by said supporting means; cutting blades mounted on each shaft and arranged so that said cutting blades alternate in inclined direction with respect to the longitudinal axis of the shaft, a first one of said blades being directed upward and forming an angle of 45° with respect to the longitudinal axis of the shaft, second and third adjacent neighboring blades being directed downward and forming an angle of 45° with respect to the longitudinal axis of the shaft, a timber to be hewed being fed horizontally between said vertical cutting shafts, each cutting shaft having said direction alternating blades distributed about the periphery of the shaft at equal intervals, said cutting blades being driven synchronously so than when an upward directed blade is in contact with one side of a timber then a downward directed blade on the other shaft is in contact with the opposite side of the timber, said cutting blades having parallel cutting edges in contact with substantially parallel opposite surfaces of the timber.

* * * * *